US007815704B2

(12) United States Patent
Schmierer et al.

(10) Patent No.: US 7,815,704 B2
(45) Date of Patent: Oct. 19, 2010

(54) DEVICE FOR DETACHABLY SECURING A DUST FILTER BAG IN DUST ASPIRATING EQUIPMENT

(75) Inventors: Uwe Schmierer, Rügland (DE); Günther Eigenwillig, Nürnberg (DE); Herbert Krehan, Fürth (DE); Jürgen Rammig, Neuendettelsau (DE)

(73) Assignee: Branofilter GmbH, Diethenhofen (DE)

( * ) Notice: Subject to any disclaimer, the term of this patent is extended or adjusted under 35 U.S.C. 154(b) by 896 days.

(21) Appl. No.: 11/705,140

(22) Filed: Feb. 12, 2007

(65) Prior Publication Data

US 2007/0266680 A1 Nov. 22, 2007

(30) Foreign Application Priority Data

Apr. 12, 2006 (DE) ..... 20 2006 006 268 U

(51) Int. Cl.
*B01D 59/00* (2006.01)

(52) U.S. Cl. ..... 55/374; 55/367; 55/369; 55/378; 55/DIG. 2; 15/347

(58) Field of Classification Search ..... 55/374, 55/369, 367, 377, 379, DIG. 2, 376, 378; 15/347, 320, 350, 352
See application file for complete search history.

(56) References Cited

U.S. PATENT DOCUMENTS 3,683,599 A 8/1972 Malz
6,136,056 A * 10/2000 Krehan ..... 55/367
6,261,331 B1 7/2001 Fleurier et al.
6,786,947 B2 * 9/2004 Mountford ..... 55/367

(Continued)

FOREIGN PATENT DOCUMENTS

DE 26 49 239 A1 5/1978

(Continued)

*Primary Examiner*—Jason M Greene
*Assistant Examiner*—Karla Hawkins
(74) *Attorney, Agent, or Firm*—Browdy and Neimark, PLLC

(57) ABSTRACT

A device for detachably securing a dust filter bag in dust aspirating equipment, comprises a flange part of rigid material seated externally on the bag wall and having a passage opening aligned with an inlet opening in the bag wall, and an equipment specific adapter plate of rigid material, which on the one hand is able to be secured to the dust aspirating equipment and on the other hand is able to be detachably connected with the flange part by means of a plug and detent joint. The adapter plate has a through opening which in the connected state is flush with the passage opening in the flange part and together with same has a through opening constituting a flow opening with the same and an annular seal and in the connected state effective between the adapter plate and the flange part for sealing off the through opening from the outside. The flange part in a oblique position inclined away from the adapter plate, is able to be plugged to the adapter plate and in the plugged state is connected with the adapter plate so that the flange part is able to be pivoted toward the adapter plate into a position of use connected by detent means with the adapter plate and arranged coaxially in relation to the adapter plate, in which position a sealing face on the flange part or of the adapter plate is held against the annular seal arranged on the adapter plate or, respectively, the flange part.

17 Claims, 7 Drawing Sheets

U.S. PATENT DOCUMENTS

| | | | |
|---|---|---|---|
| 2004/0045119 | A1 | 3/2004 | Ponjican et al. |
| 2005/0279060 | A1 | 12/2005 | Schmierer et al. |

FOREIGN PATENT DOCUMENTS

| | | | |
|---|---|---|---|
| DE | 298 80 127 | U1 | 1/2000 |
| DE | 20 2004 020 775.3 | | 1/2006 |
| DE | 20 2004 020 775 | U1 | 2/2006 |
| WO | WO 92/13479 | A1 | 8/1992 |

* cited by examiner

DEVICE FOR DETACHABLY SECURING A DUST FILTER BAG IN DUST ASPIRATING EQUIPMENT

BACKGROUND OF THE INVENTION

The invention relates to a device for detachably securing a dust filter bag in dust aspirating equipment, comprising a flange part of rigid material seated externally on the bag wall and having a passage opening aligned with an inlet opening in the bag wall, and an equipment-specific adapter plate of rigid material, which on the one hand is able to be secured to the dust aspirating equipment and on the other hand is able to be detachably connected with the flange part by means of a plug and detent joint, the adapter plate having a through opening which in the connected state is flush with the passage opening in the flange part and together with same has a through opening constituting a flow opening with the same and an annular seal effective in the connected state between the adapter plate and the flange part for peripherally sealing off the through opening to the outside.

THE PRIOR ART

Vacuum cleaning devices make use of filter bags for collecting dust. Here a suction current is produced by means of a fan drawing the dust into a suction hose or the like so that it is thence drawn via an inlet opening into the filter bag. The dust contained in the aspirated air is retained by the bag wall. The air current freed of dust passes though the bag wall and is then blown out into the surrounding. When the filter bag is full, it is removed and may be disposed of. Then a new filter bag is inserted into the dust aspirating equipment.

Securing the filter bag to the dust aspirating device is normally done using a connection means externally fitted to the bag wall at the inlet opening and having a flow opening or passage flush with the said inlet opening. Vacuum cleaners presently available of various manufacturers however as a rule have different bag holders so that a corresponding number of filter bag types must be produced, which respectively have different connection members. This leads to a complex situation.

Accordingly the German patent publication (utility model) 20 2004 020 775 U1 proposed a device of the type initially mentioned rendering possible the use of identically designed dust filter bags for dust aspirating equipment having different bag holding means. For this purpose hitherto use has been made of the conventional connection member divided into an adapter plate and a flange part seated on the filter bag, the adapter plate being adapted on the one hand to the holding means of the respective vacuum cleaner and on the other hand being able to be connected with the flange part, which is always the same. Thus the unchanged dust filter bag may be employed with dust aspirating equipment having different holding means, since the adaptation to the respective holding means is performed by the adapter plate. Accordingly it is merely necessary to provide adapter plates adapted to the different holding means, which are all able to be detachably connected with the filter bag flange part, which is always the same. The manufacturer is only obliged to offer a plurality of adapter plates for the different holding means respectively for various different dust aspirating equipment, which all are able to be detachably secured to the same flange part. The housewife then merely has to select the adapter plate suited to her vacuum cleaner. which she may then use for all filter bags she has purchased. The adapter plate may permanently remain in the vacuum cleaner even after changing the filter bag or on changing the filter bag may be removed together with it and clear of the vacuum cleaner may be connected with the flange part of a fresh filter bag and then re-inserted in the vacuum cleaner.

SHORT SUMMARY OF THE INVENTION

Taking these factors into account one object of the present invention is to design a device of the type initially mentioned in the case of which, while still maintaining the advantages described in the position of use, when the adapter plate, there is a particularly effective sealing in the interface between the adapter plate and the flange part and accordingly of the lumen of the flow opening in a radially outward direction.

In order to achieve these and/or other objects appearing from the present specification, claims and drawings, in the present invention the flange part radially outside the annular seal in a oblique position inclined away from the adapter plate, is able to be plugged to the adapter plate and in the plugged state is connected with the adapter plate so that the flange part is able to be pivoted toward the adapter plate into a position of use connected by detent means with the adapter plate and arranged coaxially in relation to the adapter plate, in which position a sealing face on the flange part or of the adapter plate is held against the annular seal arranged on the adapter plate or, respectively, the flange part.

Owing to the oblique plugging connection the flange part is brought into the correct position so that the position of use is automatically produced after pivoting of the flange part and the operation of the detent means. In this respect the sealing face abuts the annular seal to the fore. The flange part acts as a sort of pivoting lever so that the sealing face is thrust with a suitable degree of force against the annular seal in accordance with the leverage and there is a reliable sealing action.

The present invention inherently includes within its scope the adapter plate and the dust filter bag with a flange part as subcombinations for the device in accordance with the invention.

Further advantageous developments of the invention are defined in the claims.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES

FIG. 1 shows a device in accordance with the invention longitudinally sectioned on the line A~A in FIG. 4, the flange part seated on the dust filter bag being plugged to the adapter plate in an oblique position.

FIG. 2 acting the arrangement as in FIG. 1, with the flange part pivoted onto the adapter plate and connected with it by detent means.

DETAILED ACCOUNT OF WORKING EMBODIMENTS OF THE INVENTION

Figure 1:
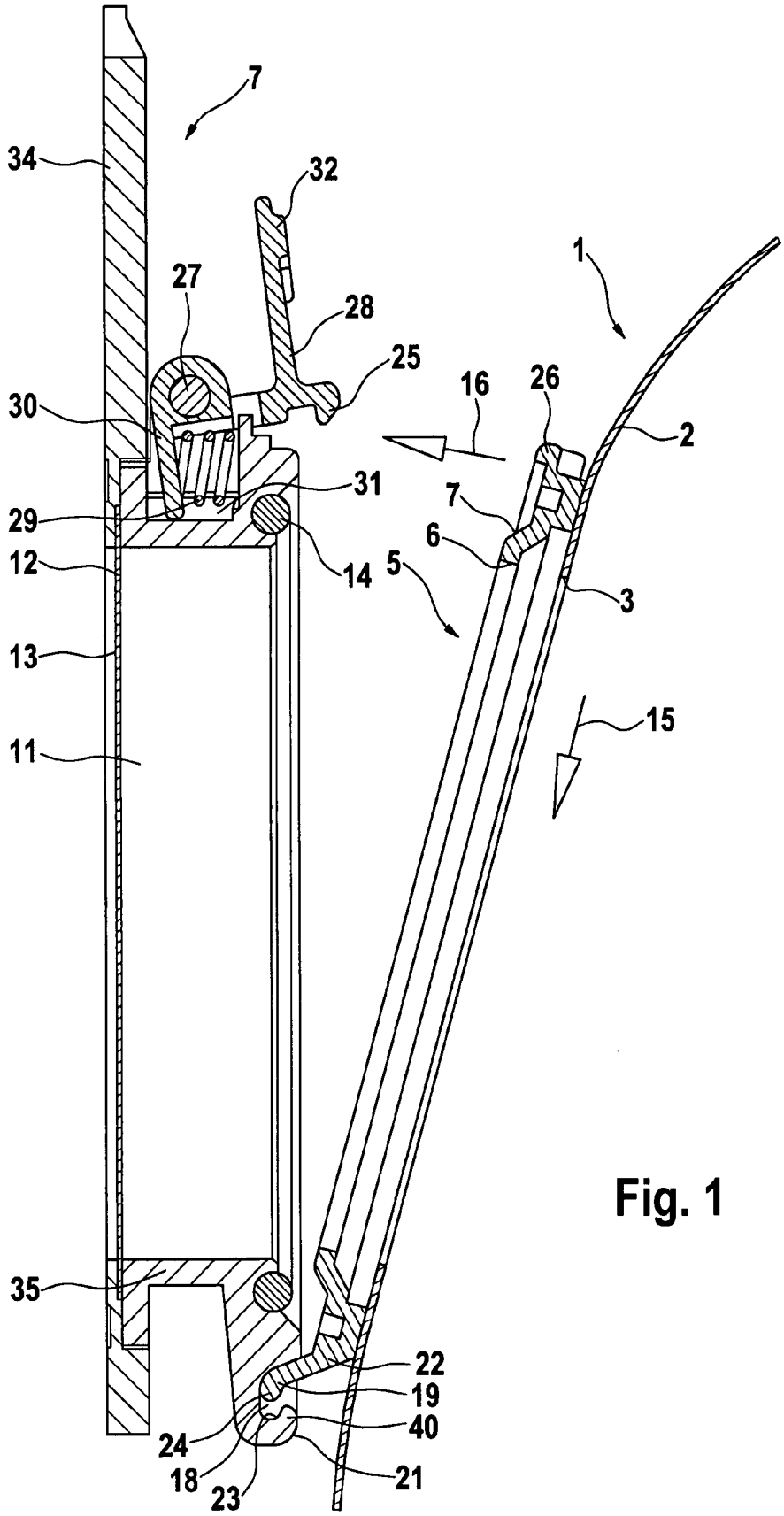

The device appearing in the drawings serves for the detachable mounting of a dust filter bag 1 in a dust aspirating device, not illustrated, which for this purpose possesses a corresponding plug connection. Of the dust filter bag 1 only a small portion of its wall 2 is shown.

The bag wall 2 consists of an air permeable material and has an inlet opening 3, through which the dust laden air passes into the interior 4 of the bag.

On the outer side of the bag wall 2 a flange part 5 of rigid material, more particularly plastic material, is attached, which is for instance bonded or welded to the wall. The flange part 5 exhibits a passage opening 6 flush with the inlet opening 3.

Furthermore there is also a device specific adapter plate 7 consisting of a rigid material such as plastic material, which on the one hand is able to be secured to the dust aspirating device and on the other hand may be connected with the flange part 5 by means of a plug and detent connection in a detachable fashion. Accordingly the filter bag 1 is connected with the flange part 5, firmly seated on it, by way of the adapter plate 7 with the respective dust aspirating device~in the following referred merely as the vacuum cleaner.

Currently available vacuum cleaners have different holding means. If for such different holding means a respectively adapted adapter plate 7 is made available, all adapter plates having the same structure on the other side, the same vacuum cleaner bag may be utilized with all vacuum cleaner types, since the flange part 5 can be connected with each adapter plate 7 independently of its side to be connected with the respective vacuum cleaner.

The adapter plate 7 may permanently remain in the vacuum cleaner so that for changing filter bags it is only a matter of changing the filter bag with its flange part 5. It is naturally also possible however to so proceed that the adapter plate 7 together with the filter bag is removed from the vacuum cleaner and the filter bag is then replaced, following which the new filter bag is re-inserted in the vacuum cleaner in a state connected with the adapter plate 7.

Figure 4:
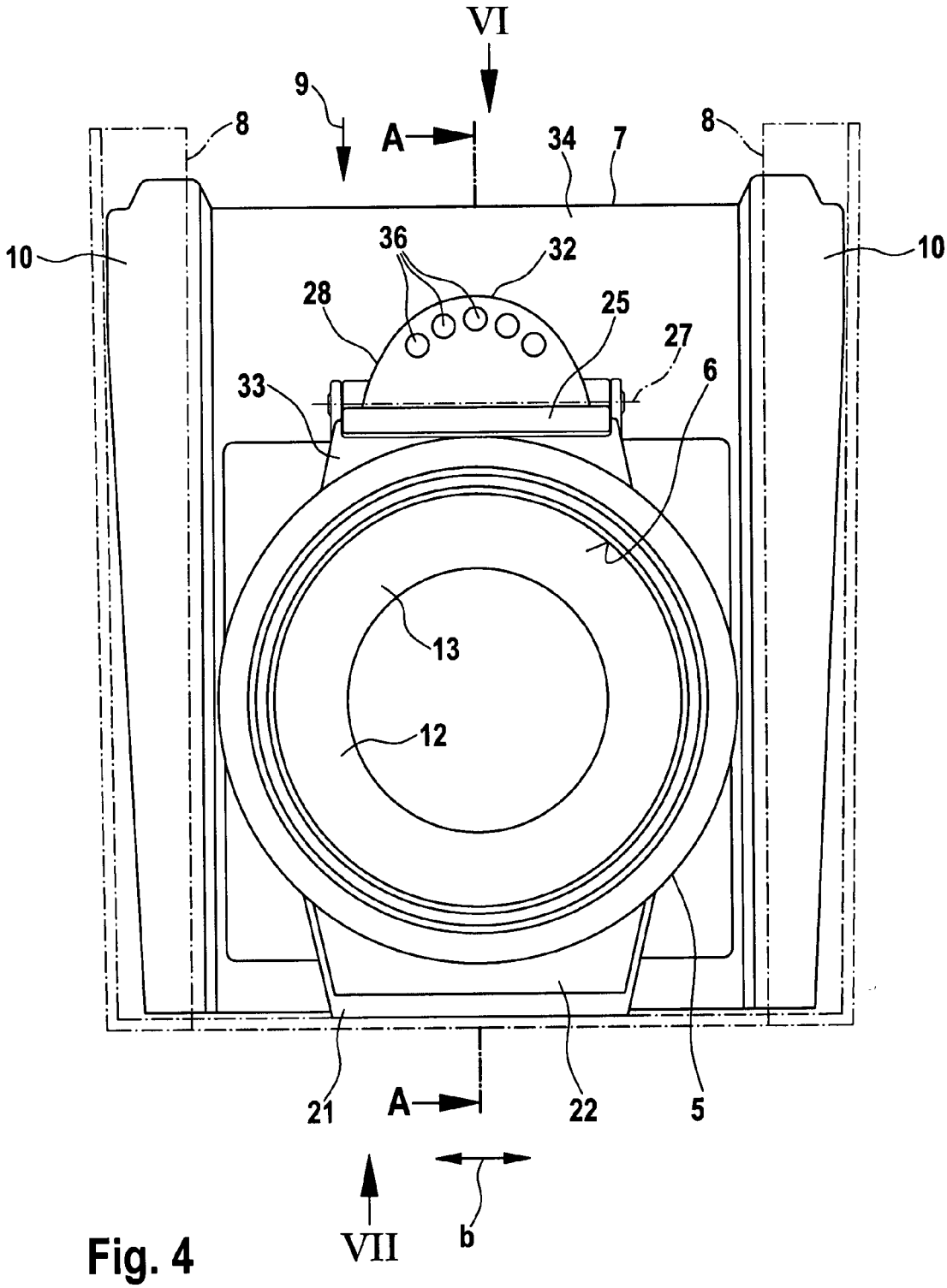
FIG. 4 shows the arrangement according to FIG. 3 in an axial plan view indicated by the arrow IV.
Figure 5:
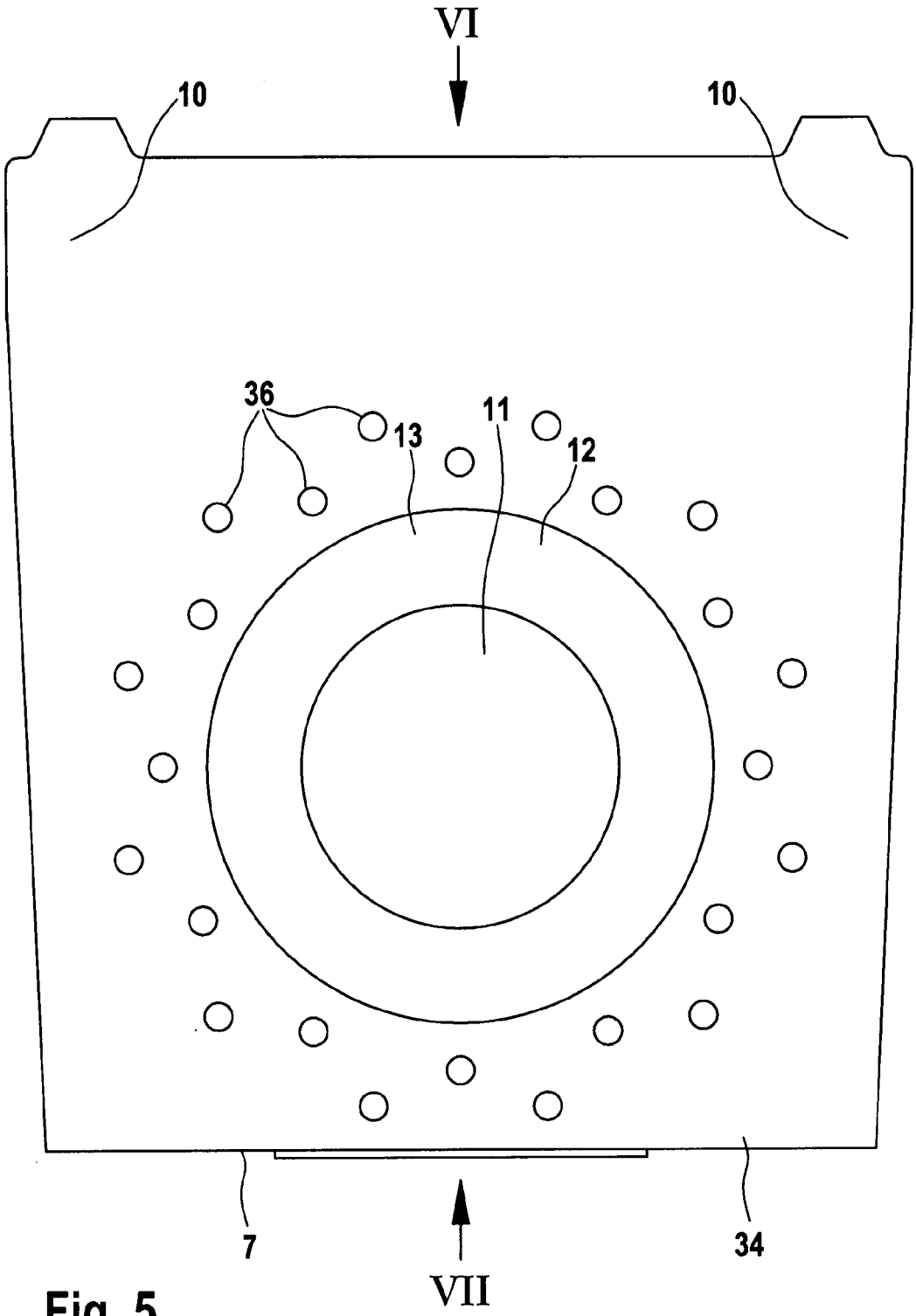
FIG. 5 shows the arrangement as in FIG. 3 but in a rear view opposite to FIG. 4 as indicated by the arrow V.
Figure 6:
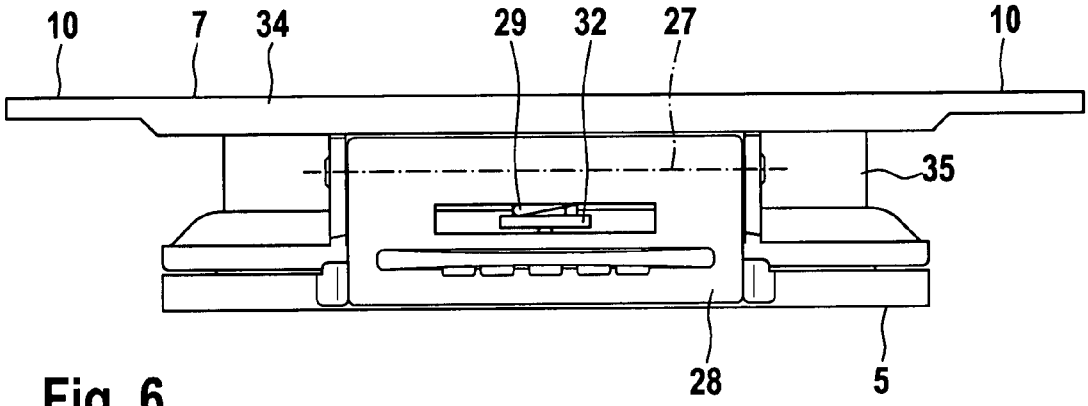
FIG. 6 shows the arrangement in accordance with FIGS. 3 through 5 in a view from above looking in the direction of the arrow VI.
Figure 7:
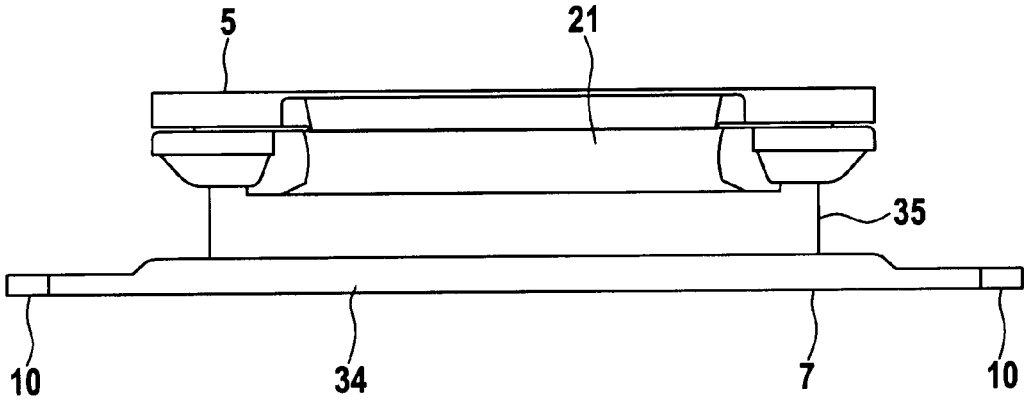
FIG. 7 shows the same arrangement in a view form below as indicated by the arrow and opposite to the direction of viewing in FIG. 6.

One of the popular holding means in a vacuum clearer is indicated in chained lines in FIG. 4. It is constituted by two guide rails 8 on the vacuum cleaner at a distance apart corresponding to the width of the adapter plate 7 and behind which the adapter plate 7 can be inserted in parallelism to its plate plane in a linear direction 9. The two lateral edge portions of the adapter plate 7 form corresponding guide ribs 10 suitable for insertion.

The adapter plate 7 comprises a through opening 11 aligned with the passage opening 6 in the state joined to the flange part 6, such opening 11 cooperating with the passage opening 6 to give a flow opening, through which the aspirated air current passes on its way to the filter bag.

The equipment also normally has a connection spigot, which with the adapter plate 7 mounted projects into or through its through opening 11. For this the adapter plate 7 bears a perforated sealing membrane 12, which constitutes an annularly surrounding sealing portion 13 extending into the through opening 11 radially and which fits around the connection spigot when the adapter plate 7 is inserted in the vacuum cleaner in a sealing fashion. Then the annular sealing portion 13 of the sealing membrane 12 is flared somewhat on insertion of the connection spigot.

Furthermore steps must be taken to ensure that during operation of the vacuum cleaner no dust leaks out at the interface or join between the adapter plate 7 and the flange part 5. Consequently there is additionally an annular seal 14 fitted to be effective between the adapter plate 7 and the flange part 5 in their connected state for preventing escape of air moving through the through opening.

The flange part 5 and the adapter plate 7 are separate parts. To produce the connection between the flange part 5 and the adapter plate 7 the arrangement is so designed that radially clear of the seal 14 the flange part 5 is, in the oblique position (see FIG. 1) slanted to be clear of the adapter plate 7, able to be plugged to the adapter plate 7 and in the plugged state is able to be is pivotally connected with the adapter plate 7 so that the flange part 5 may be pivoted in the direction of the arrow 16 toward the adapter plate 7 into a position of use (FIGS. 2 through 7 and 8) coaxial to the adapter plate 7 and held by detent action in place. In the position of use a sealing face 17 on the flange part 5 is held in engagement with the annular seal 14 arranged on the adapter plate 7, as will be seen from FIGS. 2 and 8.

In principle the parts could be reversed so that the seal would be on the flange part and the associated sealing face would be on the adapter plate.

In order to be able to be plug the flange part 5 in the oblique position in the working example (FIGS. 1 through 7) the adapter plate 7 has a plug socket 18 (which is accessible from the outside and in the working example from the front) for cooperation with an associated male plugging member 19 (which is arranged on the flange part 5) in such a manner that the male plugging member 19 may be detachably inserted into the plug socket 18. The male plugging member 19 has at one end a pivot axle part 20, which constitutes a pivot bearing axis, extending in parallelism to a tangent to the through opening 11 for pivotally supporting the flange part 5.

The female socket 18 and the male plugging member 19 extend in the width direction (b) the of the resulting pivot bearing axis accordingly. Here the plug socket 18 is arranged in a corresponding boss 21 on the adapter plate 7 and the male member 19 is arranged on a boss 22 on the flange part 5 so that the male plugging member 19 may be readily inserted by the user into the female socket 18. The end 24 (which in section is circularly arcuate and constitutes the pivot axle part 20) of the male plug member 19 assumes a position (after being inserted and lowered as indicated by the arrow 15) into a bearing groove 23 in the female socket 18, which constitutes the actual rotary bearing and furthermore also a counter abutment effective in an axial direction, against which the male plug member 19 and accordingly the flange part 5 come to rest on pivoting the flange part 5 into the position of use, when the sealing face 17 runs up against the seal 14. In this case the counter abutment is constituted by a support part 40 delimiting the plug recess 18 on the side turned away from the adapter plate 7, on the end of the plug projection 19.

Figure 8:
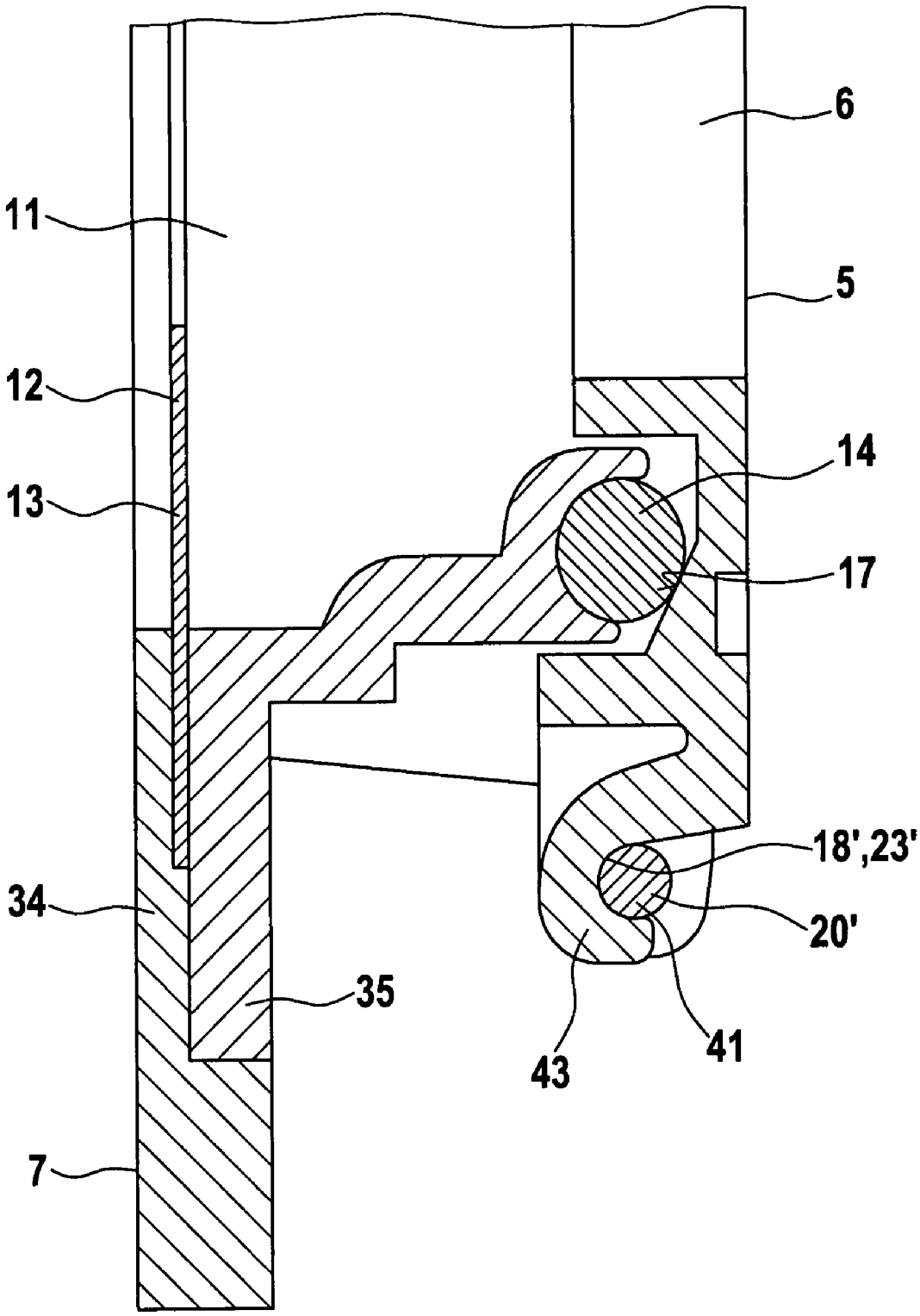
FIG. 8 shows an embodiment modified as regards the plugging connection of the flange part to the adapter plate in a part section corresponding to FIG. 2, only the portion comprising the plug being depicted.

While in the case of the embodiment in accordance with FIGS. 1 through 7 the pivot axle part 20 is arranged on the flange part 5 and the associated female socket 18 is arranged on the adapter plate 7, a reversed arrangement is also possible, as is illustrated in the working example in accordance with FIG. 8. In the case of this design the pivot axle part 20' is arranged on the adapter plate 7 and the female socket 18' is in the flange part 5.

In this case the pivot axle part 20' is constituted by a suspending pin 41 arranged in front of the adapter plate 7 and which is held by the carrying parts 42 projecting from the adapter plate 7. Furthermore the female socket 18 is in the form of a bearing groove 23' constituted by a hooked suspending part 43 on the flange part 5, which part 43 on plugging the flange part 5 onto the adapter plate 7 passes through the intermediate space between the part carrying the sealing ring 14, of the adapter plate 7 and the pivot axle part 20' in a axial direction between the adapter plate 7 and the pivot axle part 20' and is attached to the pivot axle part 20'. The hooked suspending part 43 hooks around, as illustrated, behind the pivot axle part 20' on the side facing the adapter plate 7. The pivot axle part 20' extends in parallelism to a tangent to the through opening 6.

In other respects the working example of FIG. 8 may be the same as the example of FIGS. 1 through 7.

In the case of both working embodiments instead of. having a longitudinal axle 20 and 20' it is possible to have several and in particular two longitudinal axle parts arranged in their axial direction at a distance apart. Accordingly the female socket 18 and 18' as well may be divided up into several spaced female sockets.

The linking together of the flange part 5 with the adapter plate 7 with a detent action takes place radially clear of the annular seal 14. The annular seal 14 is thus located between the pivot bearing means and the position of detent engagement of the flange part 5 in the working position of the flange part 5 so that there is a reliable and accordingly sealing pressed engagement of the sealing face 17 against the annular seal 14.

For removal of the filter bag 1 firstly the detent engagement with the adapter plate 7 is released, following which the flange part 5 is pivoted in a direction opposite to the arrowed direction 16 and is then pulled out of its connected position in the female socket 18 and 18'.

For producing a detent engagement the adapter plate 7 has a detent part 25 arranged in a moving manner on it, which fits in use behind a detent projection 25, arranged on the flange part 5, with a detent engaging action in the position of use. In this case the detent part 25 and the detent projection 26 are arranged, as related to the flow opening (constituted by the passage opening 6 and the through opening 11), opposite to the female socket 18 and 18' and to the pivot axle part 20 and 20'.

Detent engagement of the flange part 5 takes place automatically on pivoting the flange part into the position of use, because the detent projection 32 strikes the detent member 25 and deflects it against a return force, following which the detent member 25 snaps back behind the detent projection 26 under the action of the return force and causes detent engagement to take place.

It is to be noted that in principle the detent member could also be arranged on the flange part and the detent projection on the adapter plate.

In any case it is preferred for the detent member 25 to be formed on a pivot part 28 able to be pivoted about the pivot axis 27, such part 28 being pivotally mounted on the adapter plate 7 in the illustrated arrangement. In this case the pivot part 28 is urged by spring force toward the detent position indicated in FIG. 2. This spring force acts on the one hand on the pivot part 28 and on the other hand bears against the adapter plate 7. The spring force may be for example produced by a helical spring 29 aligned to be parallel to the axial direction of the through opening 11. For this purpose the pivot part 28 has part 30 projecting in a direction parallel to the adapter plate 7 and which fits into a recess 31 from the periphery of the adapter plate 7 and molded into such the adapter plate, the helical spring 29 being received in the recess 31.

As mentioned the detent engagement takes place automatically. In order to overcome the detent engagement for removal of the filter bag 1 the detent member 25 is connected with a grip 32 forming a component of the pivot part 28. On thrusting from the front against the upwardly directed grip 32 in the form of a small plate, a pivotal force will be applied to the pivot part 28 opposite to the spring force to overcome the detent engagement.

The detent member 25 and the detent projection 26 possess an elongated configuration extending in parallelism to the pivot bearing axle part 20 so that the detent engagement occurs in the width direction b along a maximum possible length. This favors a reliable thrusting of the sealing face 17 against the annular seal 14.

The opposite female socket 18 and 18' and the associated pivot axle part 20 and 20' may be of a corresponding length if there is no subdivision as mentioned above.

The detent projection 26 can be arranged on a projecting boss 33 on the flange part.

The illustrated adapter plate 7 may, as already noted, be plugged into position from outside the vacuum cleaner in a linear direction parallel to is plate plane into the plug socket on the device. In this connection it is preferred to provide the flange part 5 so that it can be plugged into the portion lying to the fore of in the insertion direction of the adapter plate 7, as is provided in the case of the working example. This facilitates handling by the housewife.

The annular seal 14 is preferably constituted by an annular body having a circular cross section, that is to say by a so-called O-ring, on which the flange part 5 lies. Owing to the force applied by the flange part 5 in the position of use on the O-ring the ring is elastically deformed somewhat and makes snug contact with the sealing face 17.

A further convenient measure is such that the sealing face 17 has a conical configuration. Accordingly in the position of use it may conically fit into the annular seal 14 constituted by the O-ring (FIGS. 1 through 7) or can conically surround the annular seal 14 (FIG. 8). This means that the sealing face 17 and with it the flange part 5 is aligned in relation to the annular seal 14 and accordingly in relation to the adapter plate 7.

Figure 2:
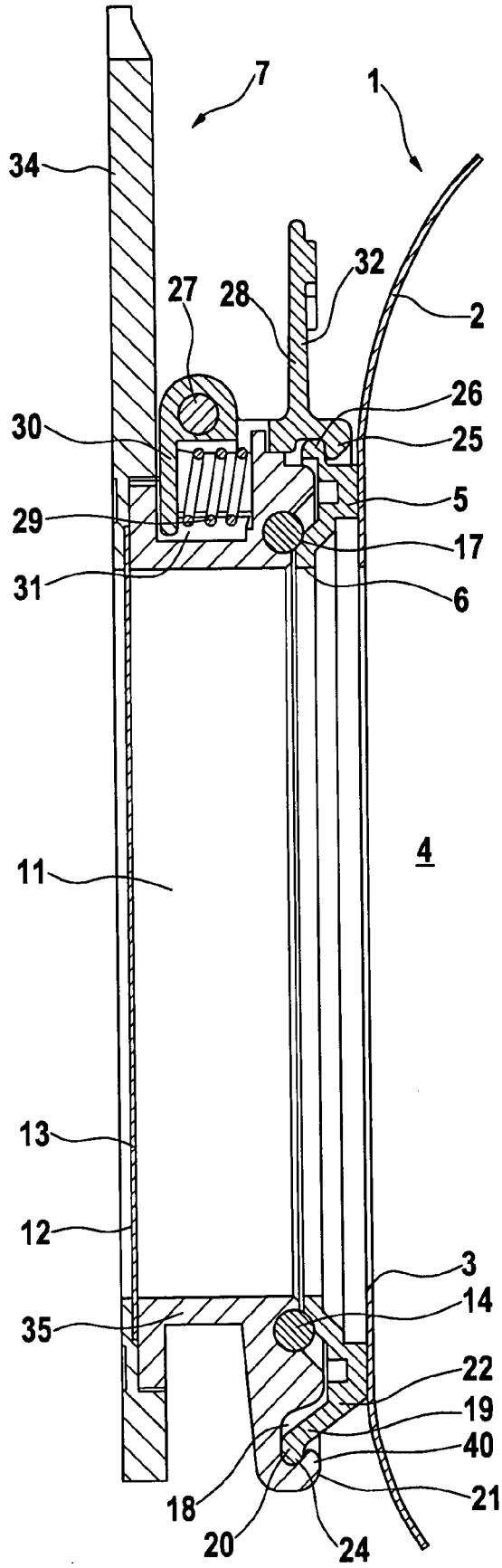
Figure 3:
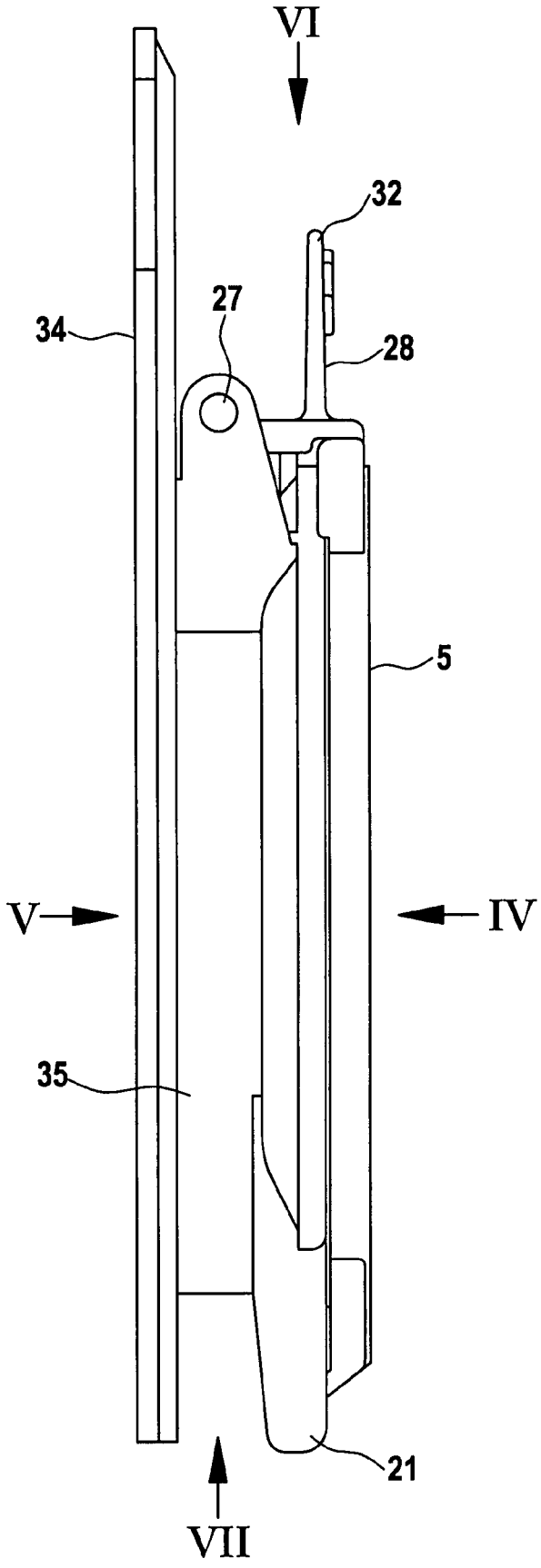
FIG. 3 shows the arrangement in accordance with FIG. 2 in a side elevation parallel to the section view in FIG. 2, the filter bag being omitted.

It further appears from the drawing that the adapter plate 7 is constituted by a plate part 34 to be secured to the vacuum cleaner and a connection part 35 able to be connected to the flange part 5 and projection from the plate part 34 like a neck. The female socket 18 in the working embodiment in accordance with FIGS. 1 through 7 or the pivot part 20' in FIG. 8, the annular seal 14 and the detent member 25 are arranged on the connection part 35. Owing to this division into two parts of the adapter plate 7 the connection part 35 (which always remains the same) can be combined with plate parts 34 adapted to different device holding means. The plate part 34 and the connection part 35 are connected together permanently in a suitable manner by way of example by screw means or by welding. This may take place, as indicated in FIGS. 1, 2 and 8, by the interposition of the external edge portion of the sealing membrane 12 so that same is held firmly in position.

The flange part 5 may have an essentially annular configuration. The two bosses 32 and 33 project in a radial direction.

Finally it will be seen from the drawing that knob-like projections 36 may be present on the rear side of the adapter plate 7 and also on the working face of the handle 32 to make them easier to take hold of.

The invention claimed is:

1. A device for detachably securing a dust filter bag in dust aspirating equipment, the equipment having a bag wall, comprising a flange part of rigid material seated externally on the bag wall and having a passage opening aligned with an inlet opening in the bag wall, and an adapter plate of rigid material, which is able to be secured to the dust aspirating equipment and is able to be detachably connected with the flange part by means of a plug and detent joint, the adapter plate having a through opening which in the connected state is flush with the passage opening in the flange part and together with said passage opening in the flange part constituting a flow opening and an annular seal effective in the connected state between the adapter plate and the flange part for peripherally sealing off the through opening from the outside, wherein the flange part radially outside the annular seal in a position inclined away from the adapter plate, is able to be plugged to the adapter plate and in the plugged state is connected with the adapter plate so that the flange part is able to be pivoted toward the adapter plate into a position of use connected by detent means with the adapter plate and arranged coaxially in relation to the adapter plate, in which position a sealing face on the flange part or of the adapter plate is held against the annular seal arranged on the adapter plate or, respectively, the flange part, wherein for pivotal mounting of the plugged on flange part at least one pivot axle part is arranged on the flange part or on the adapter plate such pivot axle part being provided with a female socket on the adapter plate or, respectively, on the flange part, wherein with the pivot axle part arranged on the flange part the pivot axle part, in the plugged state, fits behind a support part on the adapter plate and delimiting the female socket, arranged on the adapter plate, in a direction away from the adapter plate, or wherein with the pivot axle part arranged on the adapter plate the socket part is formed by a hooked suspending part on the flange part, which in the plugged on condition fits behind the pivot axle part on the side facing the adapter plate, and wherein a detent member is mounted in a moving manner on the adapter plate or on the flange part, such member fitting, in the position of use, behind a detent projection with detent engagement, such projection being arranged on the flange part or, respectively, on the adapter plate.

2. The device as set forth in claim 1, wherein the annular seal is arranged on the adapter plate and the sealing face is arranged on the flange part.

3. The device as set forth in claim 1, wherein the flange part is connected by detent means with the adapter plate radially outside the annular seal.

4. The device as set forth in claim 1, wherein the detent member and the detent projection are arranged oppositely in relation to the female socket and the plug projection.

5. The device as set forth in claim 1, wherein detent engagement takes place automatically on pivoting of the flange part into the position of use, because the detent projection strikes the detent member and deflects against a return force.

6. The device as set forth in claim 1, wherein the detent member is formed on a pivotal part able to be pivoted about a pivot axis.

7. The device as set forth in claim 6, wherein the pivot part is urged by spring force toward its position of detent engagement.

8. The device as set forth in claim 7, wherein such spring force acts on the pivot part and bears against the adapter plate.

9. The device as set forth in claim 8, wherein such spring force is provided by a helical spring directed in parallelism to the axial direction of the through opening or, respectively, of the passage opening.

10. The device as set forth in claim 1, wherein such detent member is connected with a handle for actuating the detent member.

11. The device as set forth in claim 1, wherein such detent member and the detent projection exhibit an elongated configuration extending in parallelism to the pivot bearing axis.

12. The device as set forth in claim 1, wherein in the case of an adapter plate able to be plugged into a plug holding means on the device in a linear direction parallel to the plane of its plate the flange part is able to be plugged at the portion, which lies to the fore in the plugging direction, of the adapter plate.

13. The device as set forth in claim 1, wherein the annular seal is constituted by an annular body with a circular cross section.

14. The device as set forth in claim 13, wherein the sealing face has a conical shape.

15. The device as set forth in claim 1, wherein the adapter plate is formed by a plate part to be secured to the dust aspirating device and by a connection part adapted to be connected with the flange part, the plate part and the connection being separately manufactured parts.

16. An adapter plate for said device as set forth in claim 1, wherein there is provided on the adapter plate the annular seal for sealing the passage opening from the outside or the sealing face which, in the position of use of the adapter plate when engaged with the flange part, is pressed against the annular seal located on the flange part, and that on the adapter plate a plug socket or a suspension pin is so arranged that the flange part is able to be clipped onto the adapter plate radially outside the annular seal or the sealing face in an inclined position sloping away from the adapter plate, and in the clipped-on state is able to be connected pivotably to the adapter plate, so that the flange part is able to be pivoted towards the adapter plate into a position of use coaxial to and engaged with the adapter plate, in which a sealing face or an annular seal of the flange section is held against the annular seal or sealing face located in the adapter plate.

17. A dust filter bag with a flange part for a device as set forth in claim 1, wherein located on the flange part is the sealing face which, in the position of use of the flange part in which the latter is engaged with the adapter plate, is pressed against the annular seal located on the adapter plate, or the annular seal for sealing the passage opening from the outside, and that on the flange part a plug projection with a protruding end with a circular cross-section or hook-like suspension section is so arranged that the flange part is able to be clipped on the adapter plate radially outside the annular seal or the sealing face in an inclined position sloping away from the adapter plate, and in the clipped-on state is connected pivotably to the adapter plate, so that the flange part is able to be pivoted towards the adapter plate into a position of use in which it is coaxial to and engaged with the adapter plate, and in which the sealing face or the annular seal of the flange part is held against an annular seal or sealing face located on the adapter plate.

* * * * *